US007676968B2

(12) United States Patent
Hall et al.

(10) Patent No.: US 7,676,968 B2
(45) **Date of Patent: *Mar. 16, 2010**

(54) ROLLER ASSEMBLY

(76) Inventors: David R. Hall, 2185 S. Larsen Pkwy., Provo, UT (US) 84606; Ronald Crockett, 2185 S. Larsen Pkwy., Provo, UT (US) 84606; Sigmar Tobias, 2185 S. Larsen Pkwy., Provo, UT (US) 84606

( * ) Notice: Subject to any disclaimer, the term of this patent is extended or adjusted under 35 U.S.C. 154(b) by 100 days.

This patent is subject to a terminal disclaimer.

(21) Appl. No.: 12/039,510

(22) Filed: Feb. 28, 2008

(65) Prior Publication Data

US 2008/0284236 A1 Nov. 20, 2008

Related U.S. Application Data

(63) Continuation-in-part of application No. 11/871,878, filed on Oct. 12, 2007, which is a continuation-in-part of application No. 11/748,184, filed on May 14, 2007, application No. 12/039,510, which is a continuation-in-part of application No. 11/673,634, filed on Feb. 12, 2007.

(51) Int. Cl.
*E02F 9/28* (2006.01)

(52) U.S. Cl. ..... 37/460; 175/371

(58) Field of Classification Search ..... 37/347, 37/352–365, 91–97, 446–460, 462–465; 175/227–229, 371, 375; 137/68.1, 68.23, 137/68.27, 846; 299/110
See application file for complete search history.

(56) References Cited

U.S. PATENT DOCUMENTS

| | | | | |
|---|---|---|---|---|
| 4,035,024 A | | 7/1977 | Fink | |
| 4,189,183 A | | 2/1980 | Borowski | |
| 4,381,038 A | | 4/1983 | Sugden | |
| 4,548,442 A | | 10/1985 | Sugden | |
| 5,074,063 A | | 12/1991 | Vannette | |
| 5,219,380 A | | 6/1993 | Young | |
| 5,295,735 A | | 3/1994 | Cobbs | |
| 5,392,540 A | | 2/1995 | Cooper | |
| RE035,088 E | | 11/1995 | Gilbert | |
| 5,490,339 A | | 2/1996 | Accettola | |
| 5,570,750 A | * | 11/1996 | Williams | 175/371 |
| 5,655,614 A | * | 8/1997 | Azar | 175/404 |
| 5,961,185 A | | 10/1999 | Friant | |
| 6,053,264 A | * | 4/2000 | Frankel et al. | 175/371 |
| 6,092,611 A | * | 7/2000 | Saxman | 175/227 |
| 6,105,694 A | * | 8/2000 | Scott | 175/428 |
| 6,341,823 B1 | | 1/2002 | Sollami | |
| 6,457,267 B1 | | 10/2002 | Porter | |
| 6,543,963 B2 | | 4/2003 | Bruso | |
| 6,779,948 B2 | | 8/2004 | Bruso | |
| 6,854,201 B1 | | 2/2005 | Hunter | |
| 7,150,131 B2 | | 12/2006 | Barker | |

* cited by examiner

*Primary Examiner*—Robert E Pezzuto
(74) *Attorney, Agent, or Firm*—Tyson J. Wilde; Philip W. Townsend, III

(57) ABSTRACT

In one aspect of the invention, a roller assembly has an axle that supports opposing faces of a cylindrical body that has a plurality of pointed inserts disposed along an outer diameter of the cylindrical body. At least one of the inserts has a tip with a polycrystalline diamond bonded to a cemented metal carbide segment. The diamond has a substantially conical geometry with a 0.50 to 0.200 inch radius apex and comprises a thickness greater than 0.100 inches at the apex. The roller assembly has an internal lubrication mechanism adapted to apply lubrication between the axle and the cylindrical body.

20 Claims, 17 Drawing Sheets

ROLLER ASSEMBLY

CROSS REFERENCE TO RELATED APPLICATIONS

This application is a continuation in-part of U.S. patent application Ser. No. 11/871,878, filed Oct. 12, 2007 which is a continuation-in-part of U.S. patent application Ser. No. 11/748,184 which was filed on May 14, 2007 and is herein incorporated by reference for all that it discloses. This application is also a continuation-in-part of U.S. patent application Ser. No. 11/673,634 which was filed on Feb. 12, 2007 and is herein incorporated by reference for all that it discloses.

BACKGROUND OF THE INVENTION

In the trenching industry, earth may be degraded using picks or teeth to break up minerals and rocks. Picks are usually attached to chain driven assemblies and are used for making trenches in the earth for installing pipes and utility lines and digging foundations for homes or other buildings.

U.S. Pat. No. 4,035,024 to Fink, which is herein incorporated by reference for all that is contains discloses a hard rock trench cutting machine including a main body assembly, a cutter wheel assembly, and a longitudinal thrust assembly. The main body assembly includes two longitudinally extending cantilever support booms each having a forward portion and a rearward portion. The rearward portions of the support booms are connected to four side wall support feet which move laterally relative to the support booms between a retracted position and an extended position. The cutter wheel assembly includes a cutter wheel frame slidably disposed on the forward portion of the support booms. A cutter wheel drum carrying a plurality of roller cutters is rotatably carried by the cutter wheel frame for rotation about an axis. The longitudinal thrust assembly extends between the main body assembly and the cutter wheel assembly for pushing the roller cutters against the trench end face.

U.S. Pat. No. 5,961,185 to Friant et al, which is herein incorporated by reference for all that 1 contains discloses an improved disc type rolling rock cutter, and novel cutterheads employing such cutters. A rock cutter with an improved, simplified structure, with compact bearing, and smooth, rounded blade shape is disclosed. The design incorporates a cutter ring, bearing, and seal into a single cutter ring assembly. The cutter may be assembled and disassembled for rework by a single worker with simple hand tools. Replacement of worn out cutter rings is done quickly and easily by removing the old ring assembly and then sliding a new ring, bearing, and seal assembly on to the cutter shaft.

U.S. Pat. No. 5,295,735 to Cobbs et al, which is herein incorporated by reference for all that it contains discloses a device for cutting trenches in hard rock. A plurality of disc-like primary cutters are positioned on arms around a frame. The frame rotates about a central shaft and the center shaft is moved along horizontally in the direction the trench is to be cut. Between the primary cutters are reaming cutters. Each primary and each reaming cutter is provided with a plurality of spaced apart indentors secured to the external surface and each indentor has an end point and being adaptable to penetrate the rock face upon the application of working force a distance "P" and wherein the indentor end points are spaced a distance not greater then 7 P apart.

U.S. Pat. No. 4,548,442 to Sudgen et al, which is herein incorporated by reference for all that it contains discloses a first mobile mining machine for cutting mining tunnels in hard rock, which includes a horizontally swinging wheel-like cutterhead assembly mounted on a crawler and base frame assembly. The cutterhead assembly consists of a transverse horizontal axis wheel like drum on which are multiple peripherally mounted rolling cutter units. A second mobile mining machine for cutting mining tunnels in hard rock, which includes a horizontally swinging and vertically ranging wheel-like cutterhead assembly mounted on a crawler and base frame assembly.

U.S. Pat. No. 4,189,183 to Borowski which is herein incorporated by reference for all that it contains discloses a drum cutter for a mining machine includes spaced-apart pick elements projecting radially therefrom and a disc forming part of a sensing apparatus disposed to follow a preceding one of the pick elements through rotational movement of the drum cutter. A disc is mounted by a pivot pin extending generally parallel with the rotational axis of the drum cutter.

BRIEF SUMMARY OF THE INVENTION

In one aspect of the invention, a roller assembly has an axle that supports opposing faces of a cylindrical body that has a plurality of pointed inserts disposed along an outer diameter of the cylindrical body. At least one of the inserts has a tip with a polycrystalline diamond bonded to a cemented metal carbide segment. The diamond has a substantially conical geometry with a 0.50 to 0.200 inch radius apex and comprises a thickness greater than 0.100 inches at the apex. The roller assembly has an internal lubrication mechanism adapted to apply lubrication between the axle and the cylindrical body.

In some embodiments, the roller assembly may be exteriorly mounted on an outer surface of a driving mechanism adapted to engage a formation. A pick assembly may also be mounted on the outer surface and may be adapted to contact the formation after the roller assembly. In some embodiments, the driving mechanism may be a drum and/or a trenching chain. The trenching chain may comprise a plurality of links, wherein at least one roller assembly and/or at least one pick assembly is mounted on an outer surface of at least one link.

The roller assembly and/or pick assembly may be mounted offset another roller assembly and/or pick assembly on an adjacent link with respect to a direction of travel of the trenching chain. A scraper may also be mounted on a link with the roller assembly; wherein the scraper may be adapted to scrape the formation. The driving mechanism may be adapted to move the outer surface in a predetermined direction, wherein the pick assembly is positioned within one foot behind the roller assembly with respect to the direction.

The lubrication mechanism may comprise a lubricant reservoir disposed within the axle. A thickness of the cylindrical body measured between the opposing faces may be smaller than the length of the lubricant reservoir. The lubricant reservoir may be pressurized. The lubricant reservoir may also comprise a port in fluid communication with a bearing surface between the axle and the cylindrical body. The lubricant mechanism may also comprise at least one o-ring disposed coaxially with and adjacent to the cylindrical body, wherein the o-ring substantially restricts lubricant from leaking from between the axle and the cylindrical body. The lubricant mechanism may comprise a foam insert disposed within the lubricant reservoir.

The roller assembly may comprise a bushing disposed concentrically with the cylindrical body. Every other insert of the plurality of pointed inserts is oriented in an opposing direction. The pointed inserts on the roller assembly may be mounted to the driving mechanism such that the pointed inserts contact the formation to a depth no less than the pick assembly. The pointed inserts on the roller assembly may each be oriented such that the degree of variance between any two insert orientations is no greater than 90.

DETAILED DESCRIPTION OF THE INVENTION AND THE PREFERRED EMBODIMENT

Figure 1:
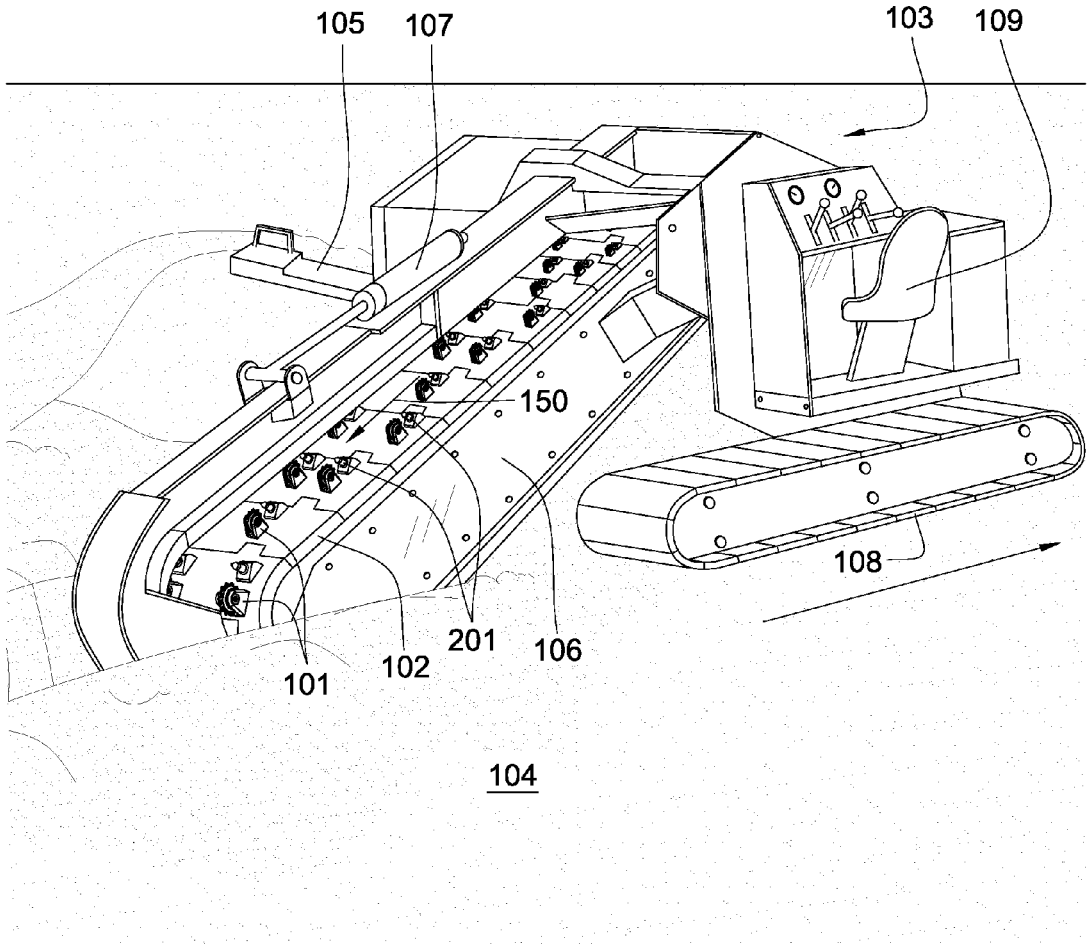
FIG. 1 is a perspective diagram of an embodiment of a plurality of rollers on a trenching machine.

FIG. 1 is a perspective diagram of an embodiment of a plurality of rollers 101 on a rotating chain 102 attached to a motor vehicle 103. The plurality of roller assemblies 101 is exteriorly mounted in a "V" pattern on the chain 102 of the boom 106 to facilitate degradation and removal of a formation 104. The roller assemblies 101 may be followed by pick assemblies 201. The chain 102 rotates in the direction of the arrow 150 and cuts the formation 104 forming a trench while bringing the formation 104 cuttings out of the trench to a conveyor belt 105 which directs the cuttings to a side of the trench. The boom 106 may be raised while the machine is being transported or it may be lowered for trenching as shown in FIG. 1. The position of the boom 106 may be controlled by a hydraulic piston and cylinder 107. The trenching machine may move about the formation 104 by tracks 108, wheels, or a combination thereof. A seat 109 for an operator is positioned on the side of the machine.

Figure 2:
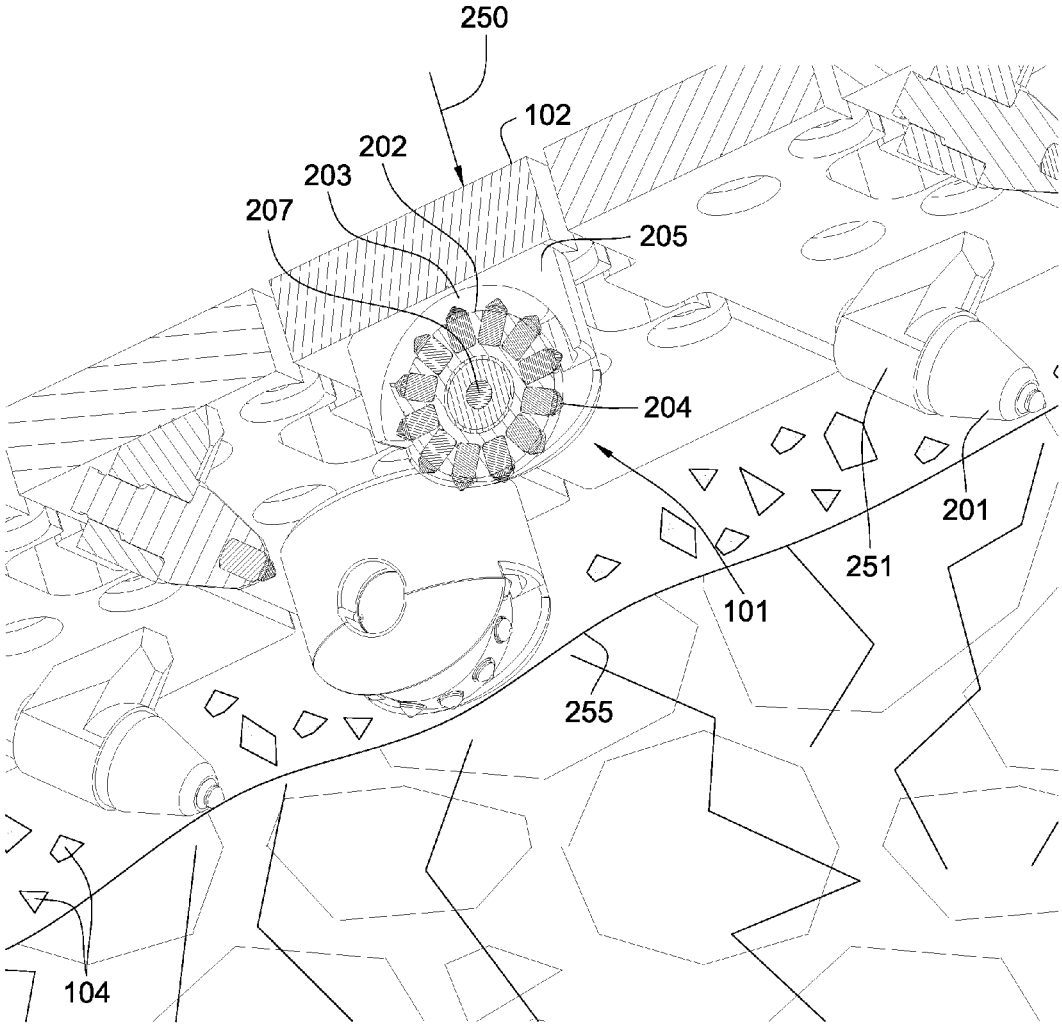
FIG. 2 is a cross-sectional diagram of an embodiment of a roller and pick assembly.

FIG. 2 is a cross-sectional diagram of an embodiment of a roller 101 and pick assembly 201 degrading a formation 104. The roller assembly 101 comprises a cylindrical body 202 with pointed inserts 203 that are radially positioned on the cylindrical body's outer diameter. The pointed inserts 203 further comprise an impact tip 204 adapted to engage the formation 104. The cylindrical body 202 is rotationally supported by a housing 205 that is attached to the chain 102. The cylindrical body 202 may have a thickness of 0.8 to 2.8 inches. The cylindrical body 202 may be attached to an axle 207 supported by the housing.

Force is applied in the direction of the arrow 250 loading weight on the pointed inserts 203. The pointed inserts 203 engage the surface at the impact tip 204, which is optimized for the wear life of the pick. Wear life is improved because the rotating motion reduces the effects of drag and wear on the pointed inserts 203. The housing 205, the cylindrical body 202, and the pointed inserts 203 may comprise or be coated by a hard material to prevent wear.

The impact tips 204 may comprise a super hard material which may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof. The super hard material may be a polycrystalline structure with an average grain size of 10 to 100 microns. The roller assembly 101 may create a wave geometry 255 in the formation 104. The pick assembly 201 may be adapted to contact the wave geometry 255 in the formation 104 and facilitate the degrading of the formation 104. The pick assembly 201 may be disposed within a holder 251 that is attached to the chain driven assembly 102.

Figure 3:
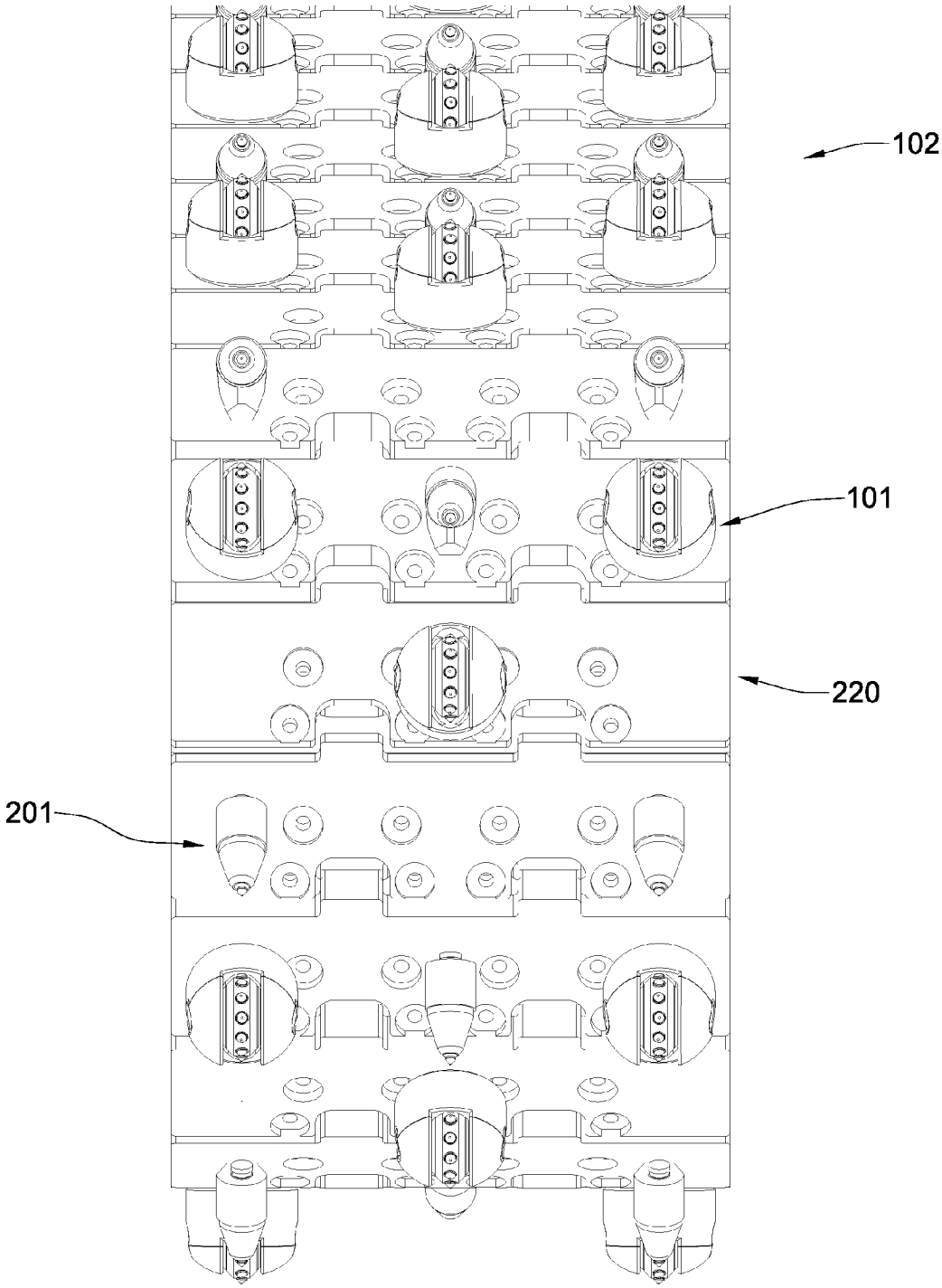
FIG. 3 is an orthogonal diagram of another embodiment of a roller assembly.

FIG. 3 is a perspective diagram of another embodiment of a roller assembly 101. The driving chain 102 comprises a plurality of roller assemblies 101 and pick assemblies 201 which are mounted thereon. Each roller assembly 101 may be followed by a pick assembly 201 with respect to the direction of travel of the driving chain 102. The roller assemblies 101 and/or pick assemblies 201 may be mounted on the driving chain 102 offset the roller 101 and/or pick assemblies 201 on an adjacent link 220.

Figure 4:
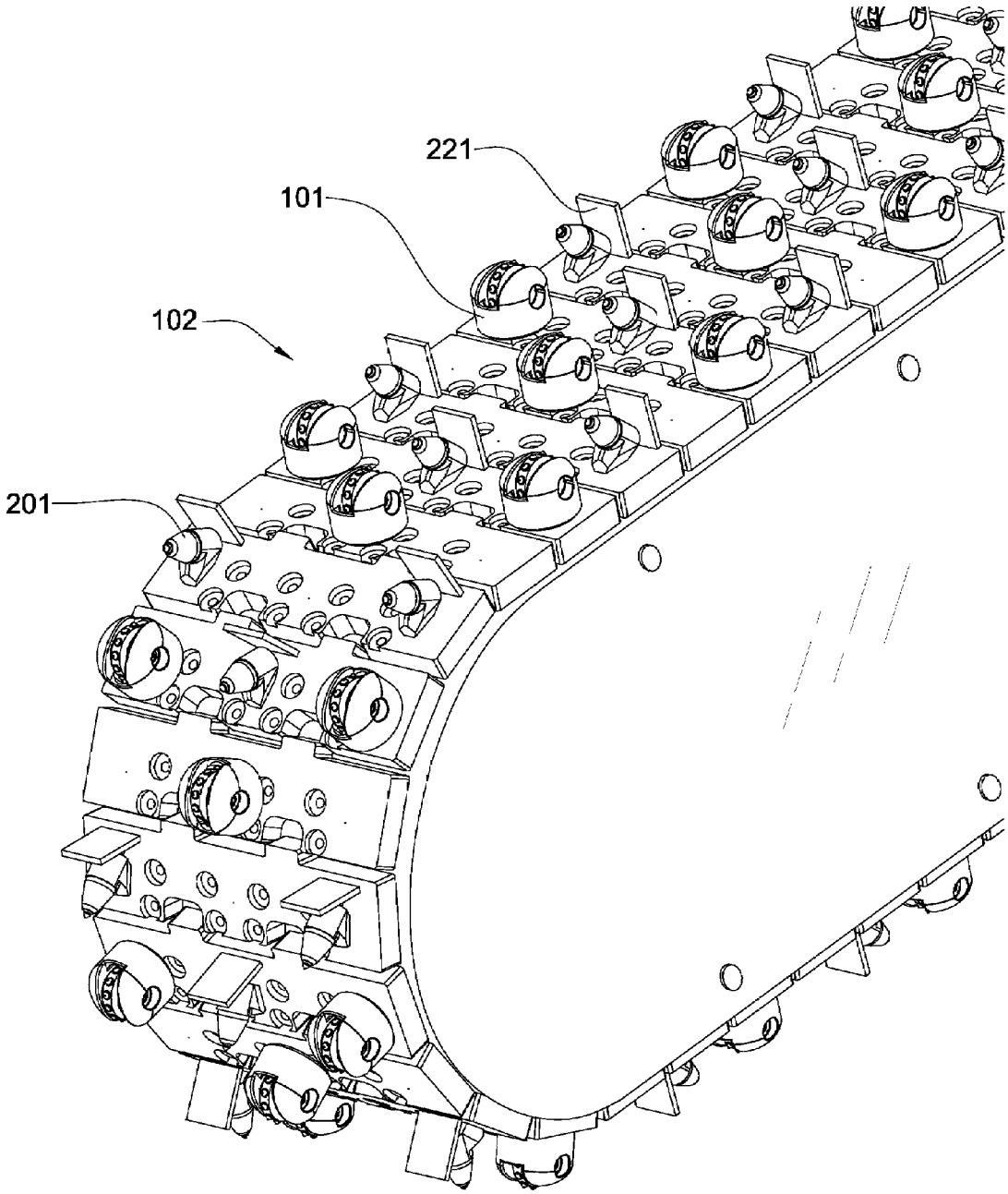
FIG. 4 is a perspective diagram of another embodiment of a roller assembly.

FIG. 4 is a perspective diagram of another embodiment of a roller assembly 101. Each of the picks 201 in the plurality of pick assemblies 201 may be mounted in front of a scraper 221 with respect to the direction of travel of the chain 102. The scraper 221 may be adapted to scrape the formation 104 (shown in FIG. 2). The formation cuttings 104 (shown in FIG. 2) may be removed by the scraper 221 after the roller 101 and pick assemblies 201 have contacted the formation 104 (shown in FIG. 2).

Figure 5:
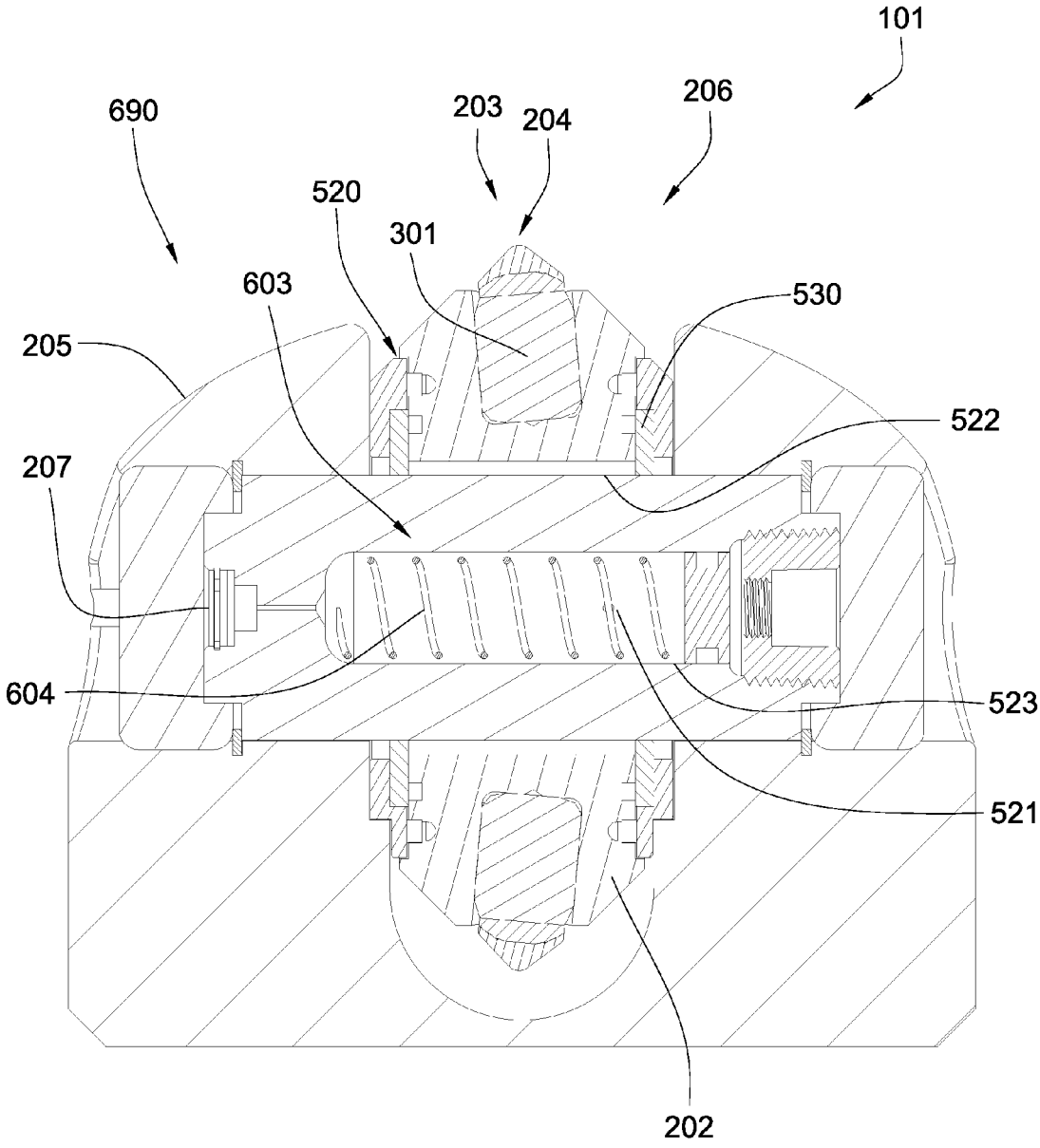
FIG. 5 is a cross-sectional diagram of an embodiment of a roller assembly.

FIG. 5 is a cross-sectional diagram of an embodiment of a roller assembly 101. The roller assembly 101 may comprise a cylindrical body 202 with two opposing faces 520. The cylindrical body 202 further comprises a plurality of pointed inserts 203 arranged radially along the outer diameter of the cylindrical body 202. The pointed inserts 203 may comprise a carbide core 301 attached to an impact tip 204 and may be press fit into the cylindrical body 202. In other embodiments, the carbide may also be brazed onto the exterior of the cylindrical body 202. The carbide core 301 may comprise a tapered end (not shown) opposite the impact tip 204. It is believed that such a geometry reduces stress risers in the roller assembly 101 which can result in fractures. The roller assembly 101 may comprise an axle 207 about which the cylindrical body 202 rotates. The roller assembly may comprise a slot 206 in which the cylindrical body 202 may be disposed. The roller assembly 101 may further comprise a lubricant mechanism 690 adapted to apply lubrication between the cylindrical body 202 and the axle 207. A port 521 in fluid communication with the axle 207 and bearing surface 522 provides access to the points of contact within the roller assembly 101. The lubricant mechanism 690 further comprises a lubricant reservoir 523 which is pressurized. The lubricant reservoir 523 is disposed within the axle 207 and includes an internal accumulator 603. The accumulator 603 may comprise a spring 604, a filter, and a throw-away filter disc, along with an accumulator vent. In some embodiments of the present invention, the spring may be a coiled spring, closed-cell foam, compression spring, tension spring, rubber, an elastomer, or a combination thereof. The accumulator 603 may act as a lubrication system comprising oil. The oil lubricates the axle 207 from the cylindrical body 202 as it rotates. An o-ring 530 may be disposed coaxially with and adjacent to the cylindrical body 202 to restrict lubricant from leaking from the lubricant reservoir 523. The axle 207 is secured in a housing 205 adapted to support the cylindrical body 202.

Figure 6:
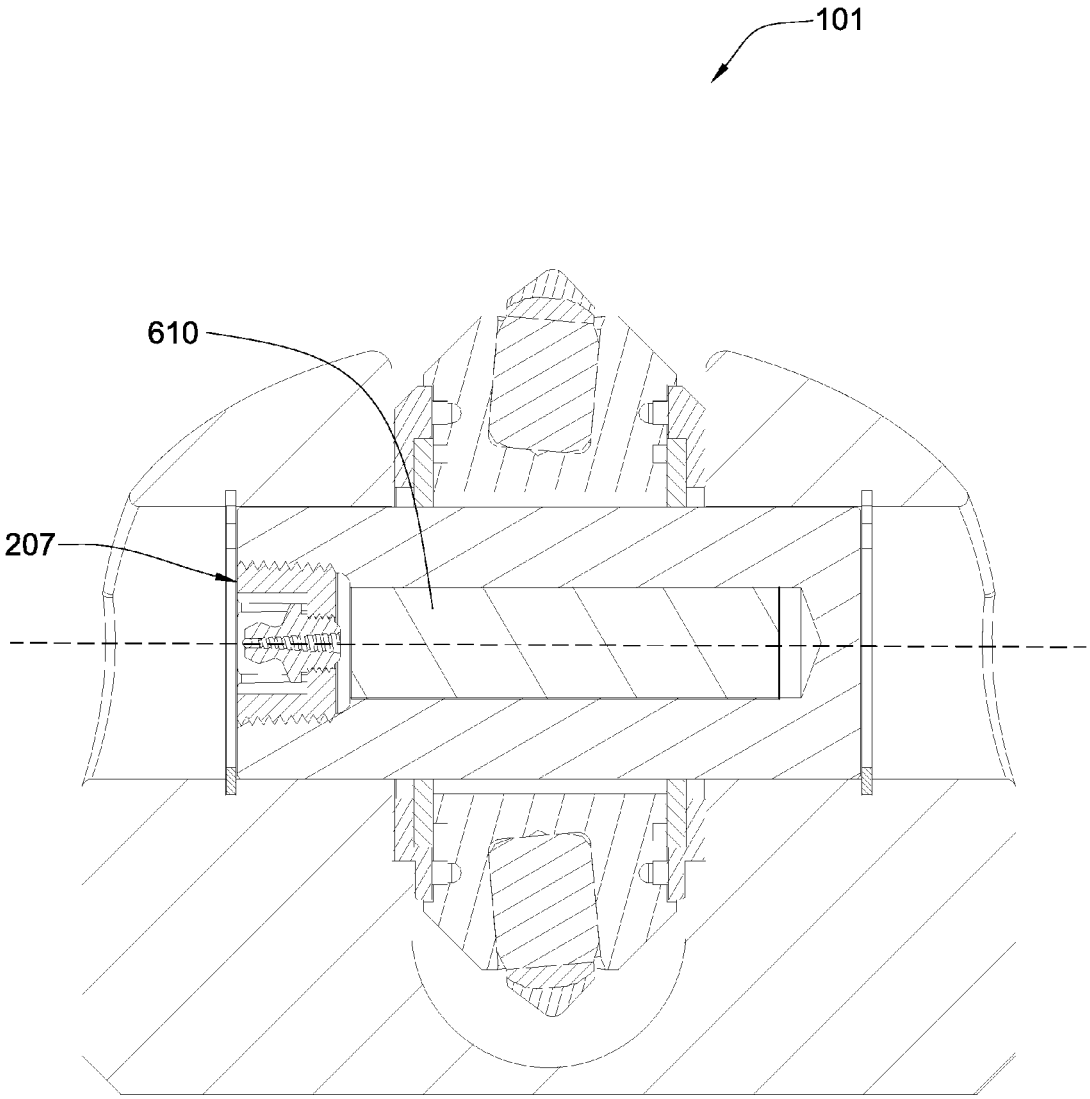
FIG. 6 is a cross-sectional diagram of another embodiment of a roller assembly.

FIG. 6 is a cross-sectional diagram of another embodiment of a roller assembly 101. The axle 207 comprises a foam insert 610 adapted to pressurize the lubricant in the lubricant reservoir. The foam may comprise a material selected from the group consisting of Silicone, Neoprene, Polyurethane and Polyethylene or a closed cell material. The foam may provide the benefit of minimizing the number of parts being used, rendering the assembly easier to use and assemble and providing cost effectiveness.

Figure 7:
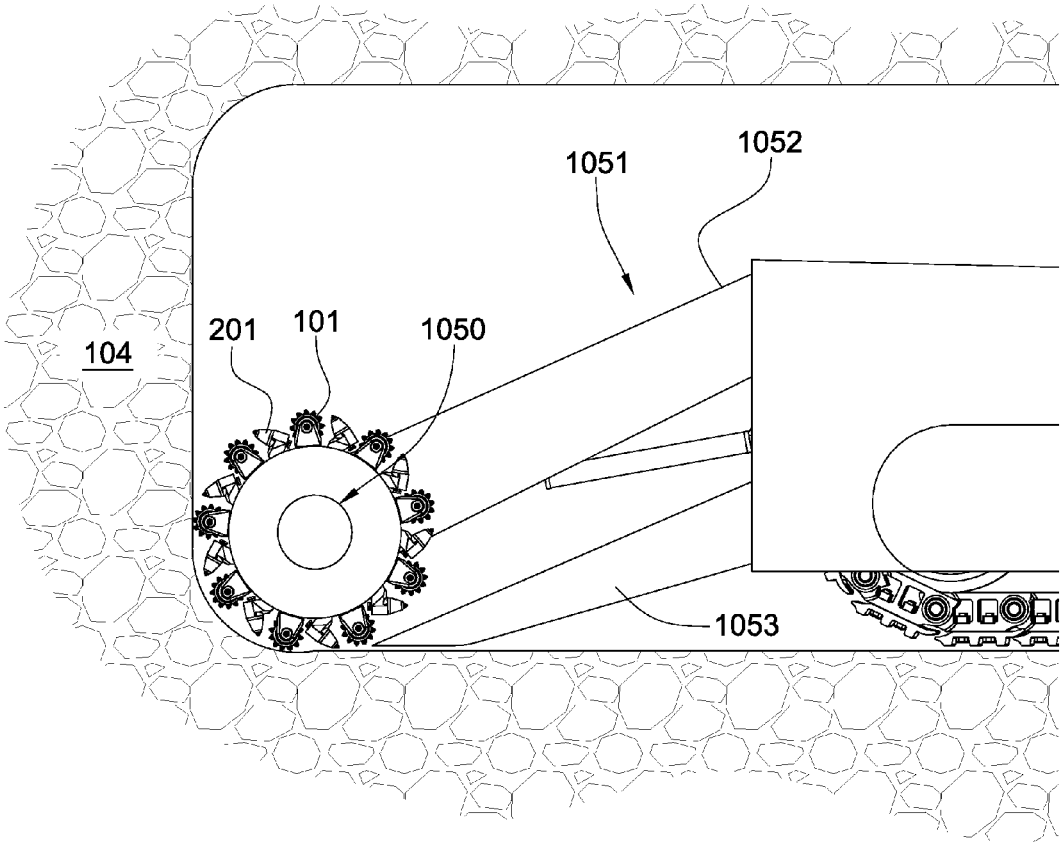
FIG. 7 is a perspective diagram of another embodiment of a plurality of rollers on a rotating drum attached to a motor vehicle.

FIG. 7 is a perspective diagram of another embodiment of a plurality of rollers 101 on a rotating drum 1050 attached to a motor vehicle 1051. The rotating drum 1050 is adapted to engage the formation 104. A plurality of picks 201 may be disposed radially on the outer diameter of the drum 1050 in between the roller assemblies 101. The motor vehicle may comprise a boom 1052 which regulates the movement of the rotating drum 1050. The boom 1052 is adapted to horizontally engage the formation 104. In some embodiments, the motor vehicle 1051 may be a mining machine. The motor vehicle may also comprise a conveyor belt 1053 to facilitate the removal of formation cuttings 104.

Figure 8:
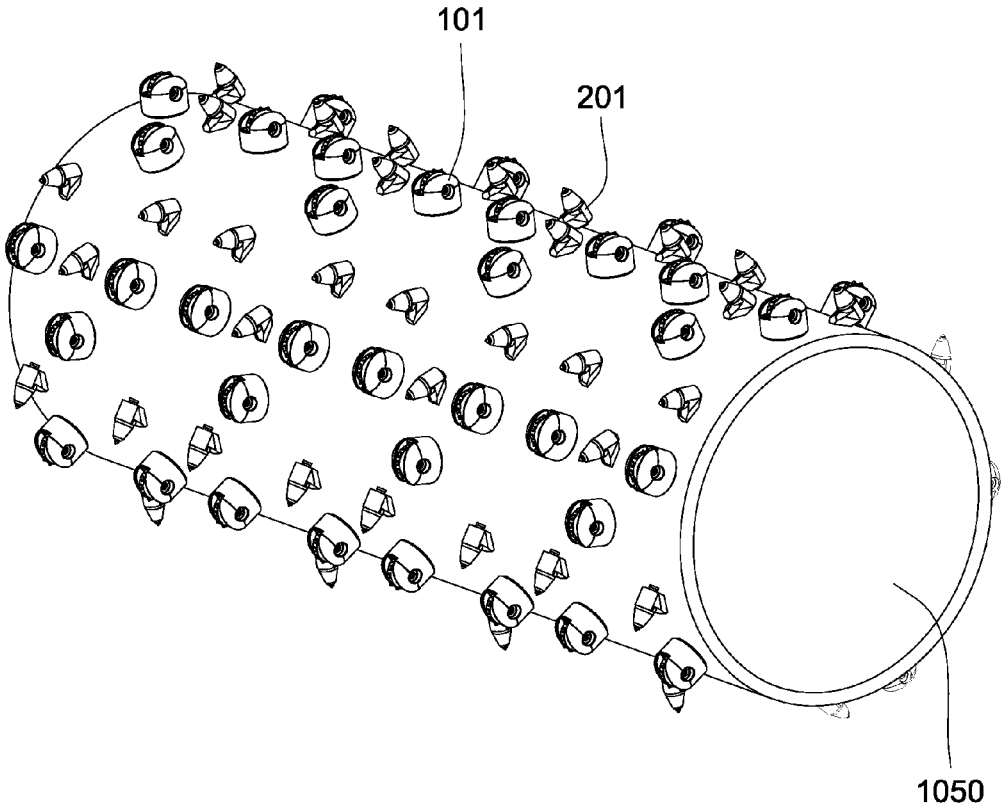
FIG. 8 is a perspective diagram of another embodiment of a roller assembly.

FIG. 8 is a perspective diagram of another embodiment of a plurality of rollers 101 on a rotating drum 1050. A plurality of picks 201 may also be disposed on the drum 1050.

Figure 9:
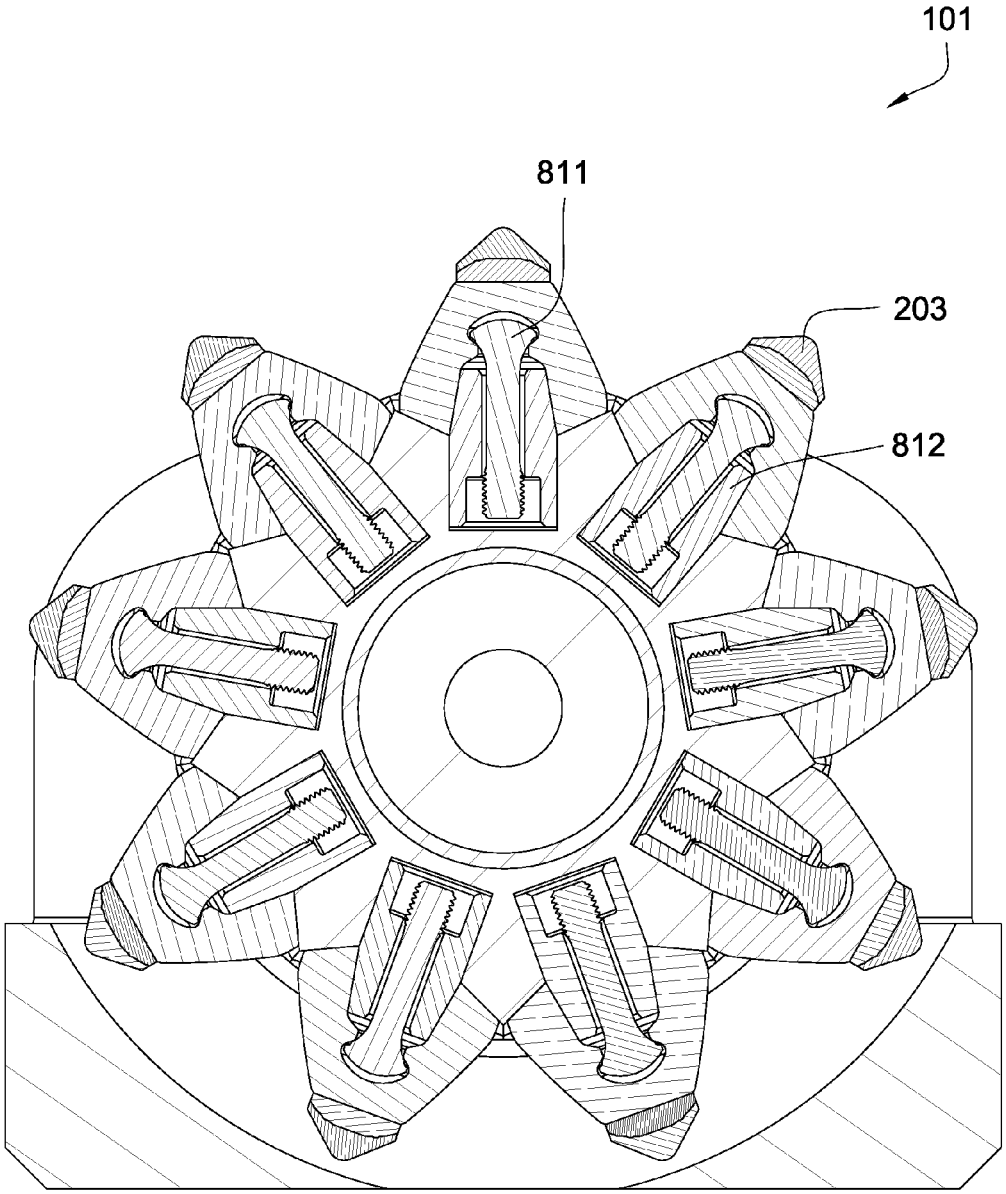
FIG. 9 is a cross sectional diagram of another embodiment of a roller assembly.

FIG. 9 shows a cross-section of an embodiment of a roller assembly 101. In this embodiment, the pointed inserts 203 are brazed to a cemented metal carbide bolster which is held in place by a tensioned pin 811. The pin may be secured into a shank 812 with a threaded nut and the shank may be press fit into the cylindrical body 202. The pin 811 may comprise a head which interlocks with the bolster.

Figure 10:
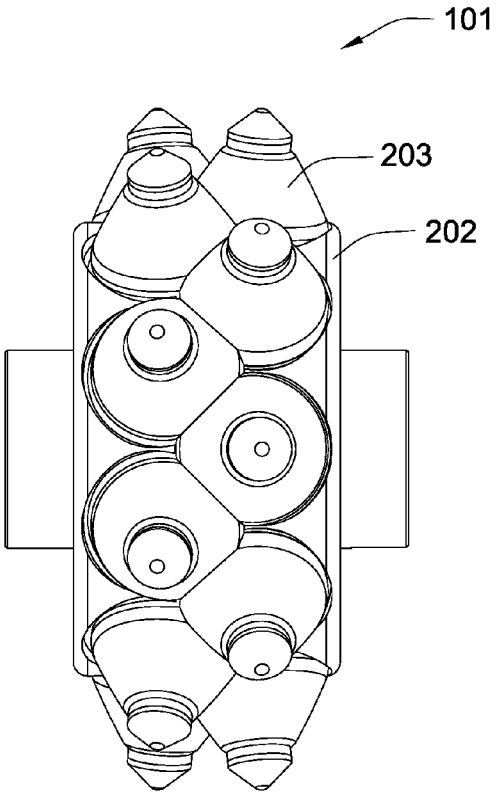
FIG. 10 is a perspective diagram of another embodiment of a roller assembly.
Figure 10A:
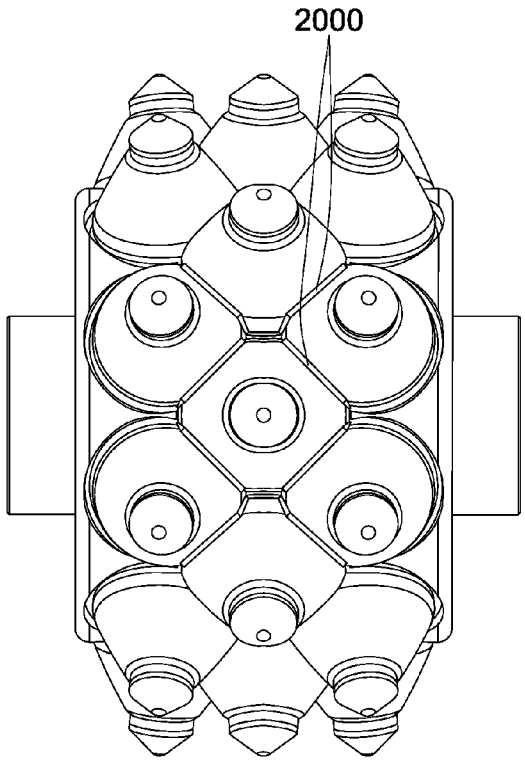

FIG. 10 shows another embodiment of a roller assembly 101. Every other pointed insert 203 may be oriented in a direction opposing the other inserts 203 along the outer diameter of the cylindrical body 202. Every other pointed insert 203 may also be offset the other pointed inserts 203. The roller assembly 101 may be skewed on the chain 102 (not shown). The bolsters may comprise a flat incorporated within its base perimeter so that the more of the cylindrical body's outer surface is covered and so that the pointed inserts may be disposed closer together. FIG. 10*a* discloses a multiple rows of inserts, with a steel shim 2000 disposed at the interface between the flats. The shims may be beneficial in preventing impact from transferring to adjacent inserts.

Figure 11:
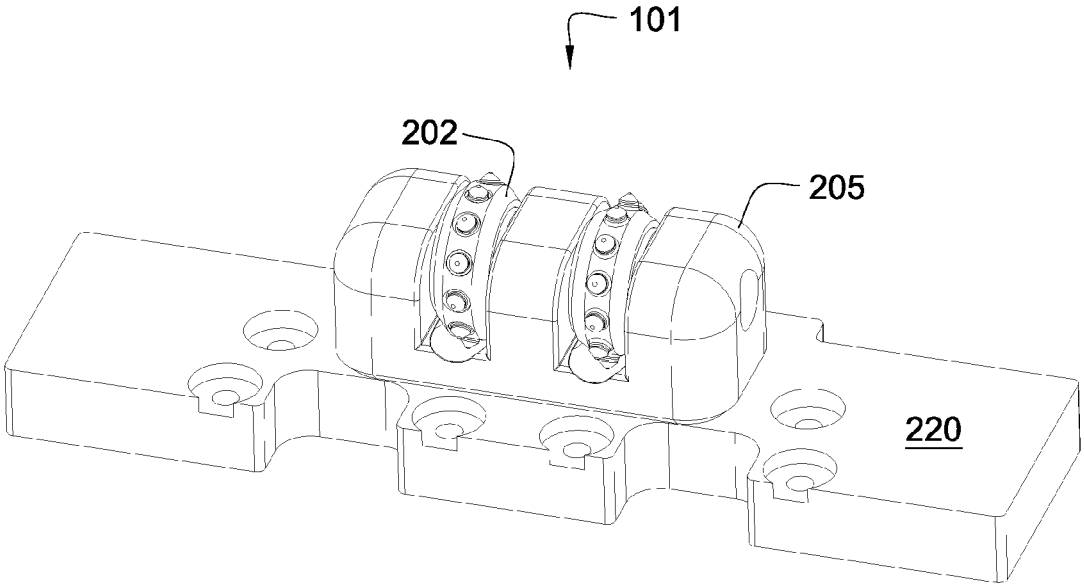
FIG. 11 is a perspective diagram of another embodiment of a roller assembly.

FIG. 11 shows an embodiment of another roller assembly 101. In this embodiment, more than one cylindrical body 202 may be comprised within the housing 205. Each cylindrical body 202 may share a common axle 207 (not shown). The housing 205 may be mounted on a link 220.

Figure 12:
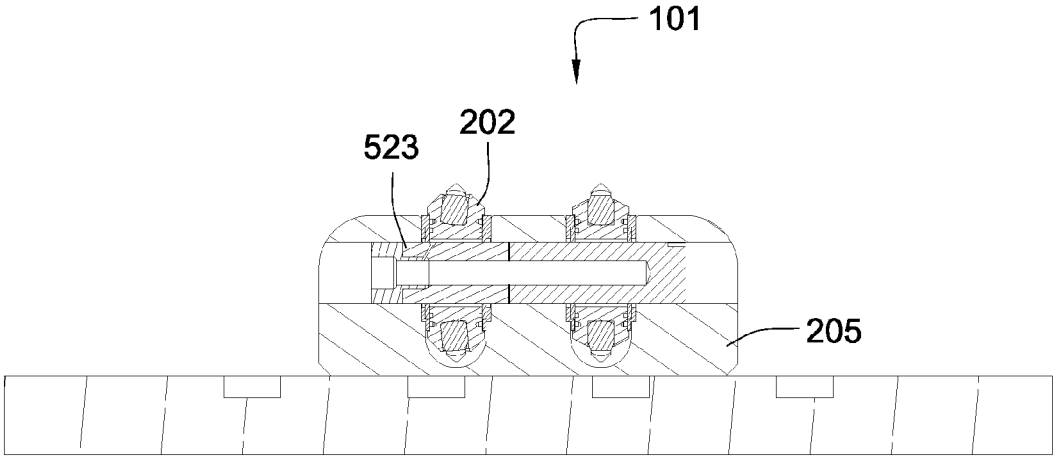
FIG. 12 is a cross sectional diagram of another embodiment of a roller assembly.

FIG. 12 shows a cross-sectional view of an embodiment of a roller assembly 101. At least two of the cylindrical bodies 202 may share a common axle. The lubricant reservoir 523 may be adapted to apply lubrication between the axle 207 and the plurality of cylindrical bodies 202. In some embodiments a single lubricant reservoir may be used for more than one cylindrical body and in other embodiments, a plurality of lubricant reservoirs may be used.

Figure 13:
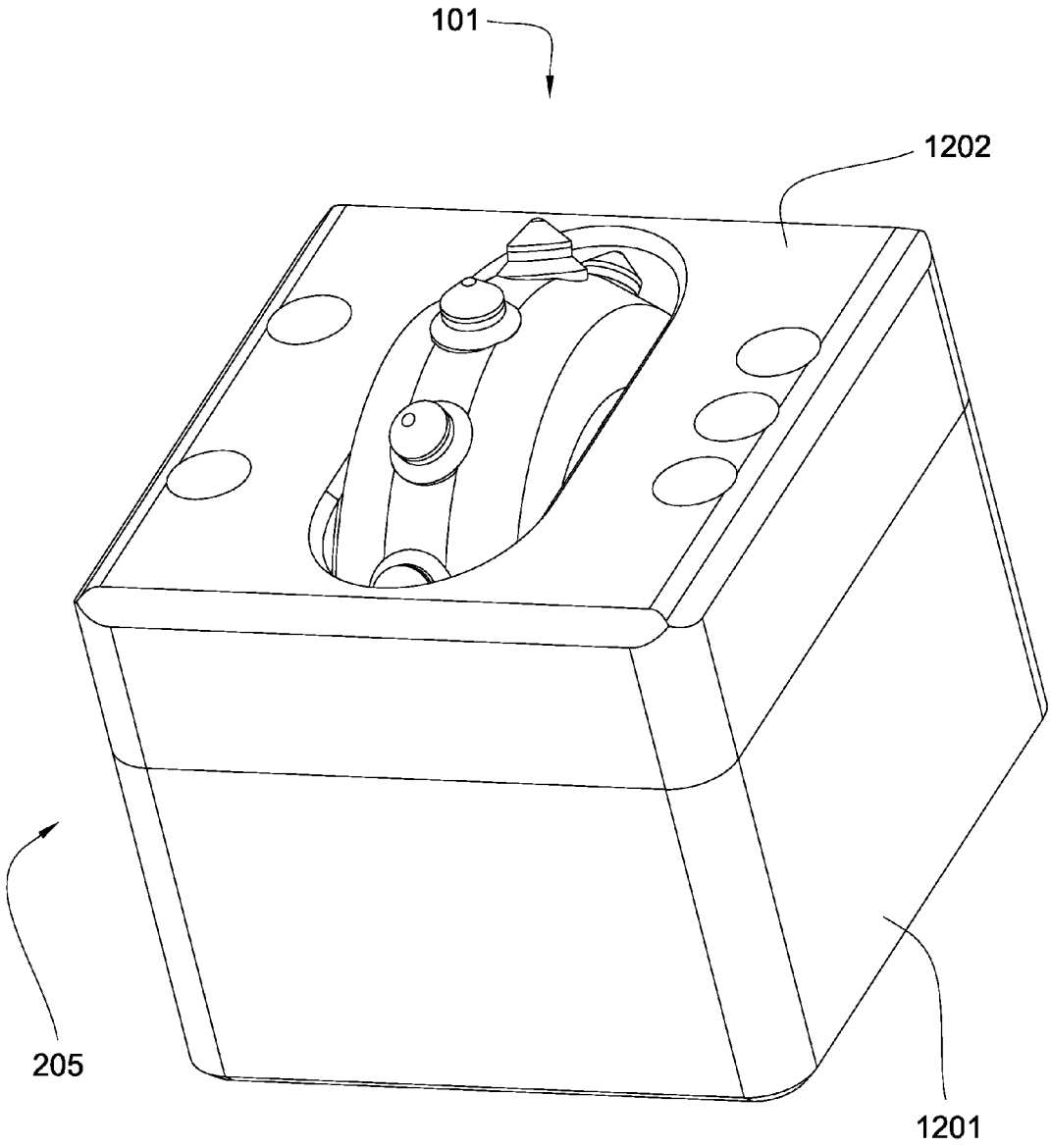
FIG. 13 is a perspective diagram of another embodiment of a roller assembly.

FIG. 13 shows another embodiment of a roller assembly 101. The housing 205 may comprise a base 1201 and a top 1202. The base 1201 may be secured to the top 1202 using mechanical fasteners and/or magnetic fasteners which in turn locks the axle 207 (not shown) to the housing 205. The fasteners may be selected from a group consisting of magnets, bolts, rivets, pins, and/or latches.

Figure 14:
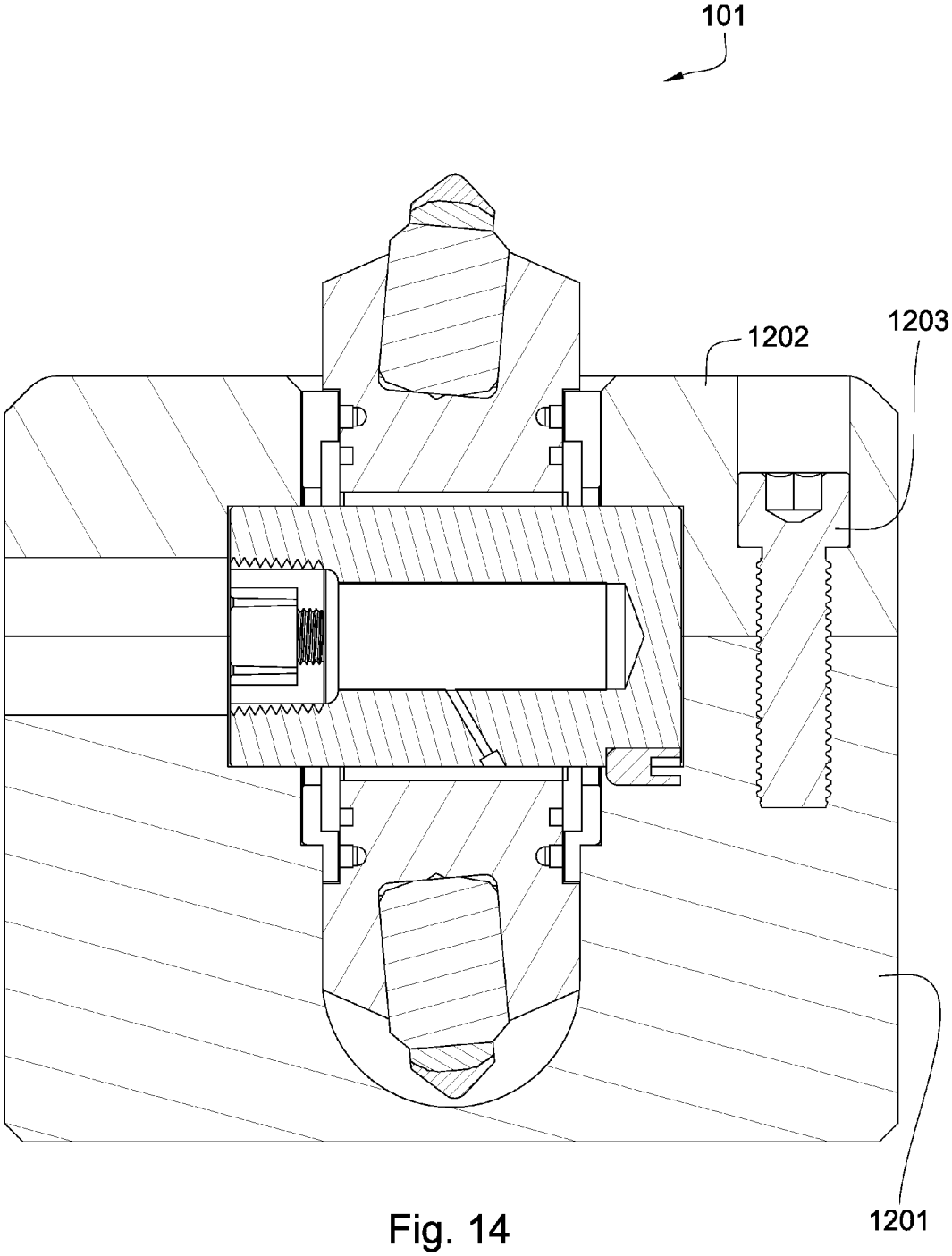
FIG. 14 is a cross sectional diagram of another embodiment of a roller assembly.

FIG. 14 shows a cross-sectional view of an embodiment of a roller assembly 101. The housing 205 may comprise a base 1201 and a top 1202. The axle 207 may be secured in place intermediate the base 1201 and top 1202 providing the base 1201 and top 1202 are fastened together. The base 1201 and top 1202 may be fastened together with a mechanical fastener 1203. The top may secure the axle within the housing.

Figure 15:
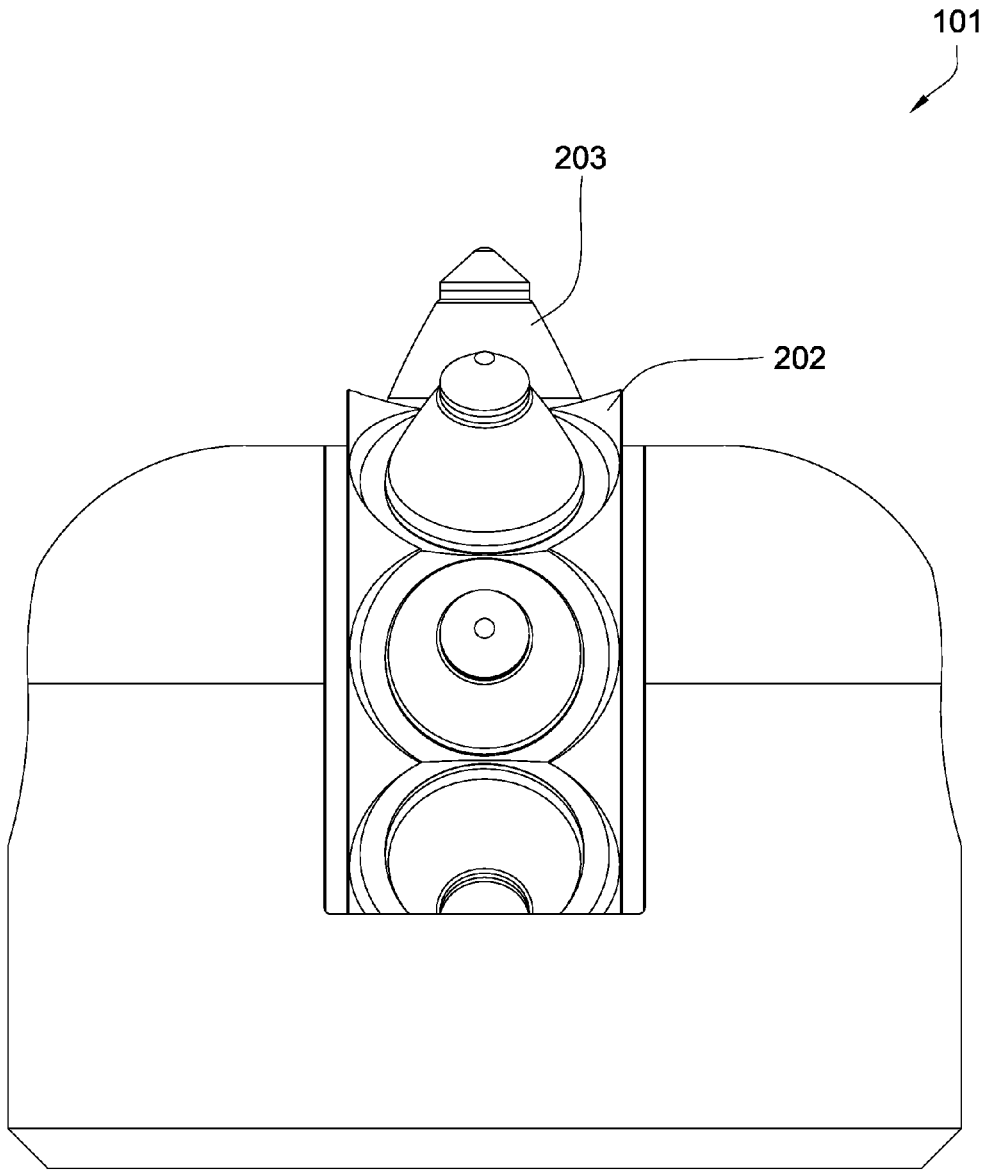
FIG. 15 is a perspective diagram of another embodiment of a roller assembly.

FIG. 15 shows another embodiment of a roller assembly 101. Pointed inserts 203 may be disposed along the outer surface of the cylindrical body 202.

Figure 16:
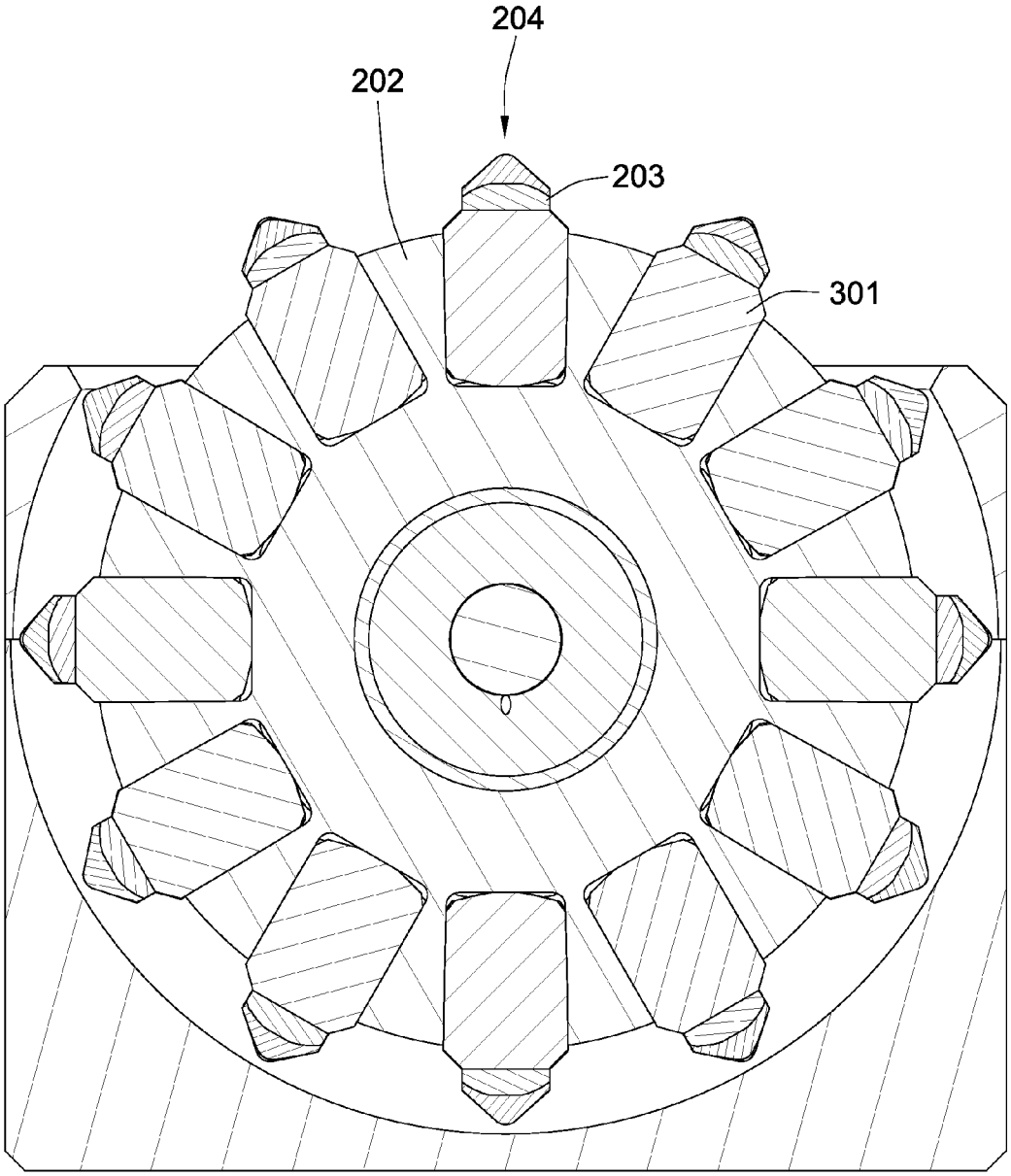
FIG. 16 is a cross sectional diagram of another embodiment of a roller assembly.

FIG. 16 shows a cross-sectional view of an embodiment of a roller assembly. Pointed inserts 203 may be disposed along the outer surface of the cylindrical body 202. The pointed inserts 203 may comprise a carbide core 301 attached to an impact tip 204 and may be press fit into the cylindrical body 202.

Figure 17:
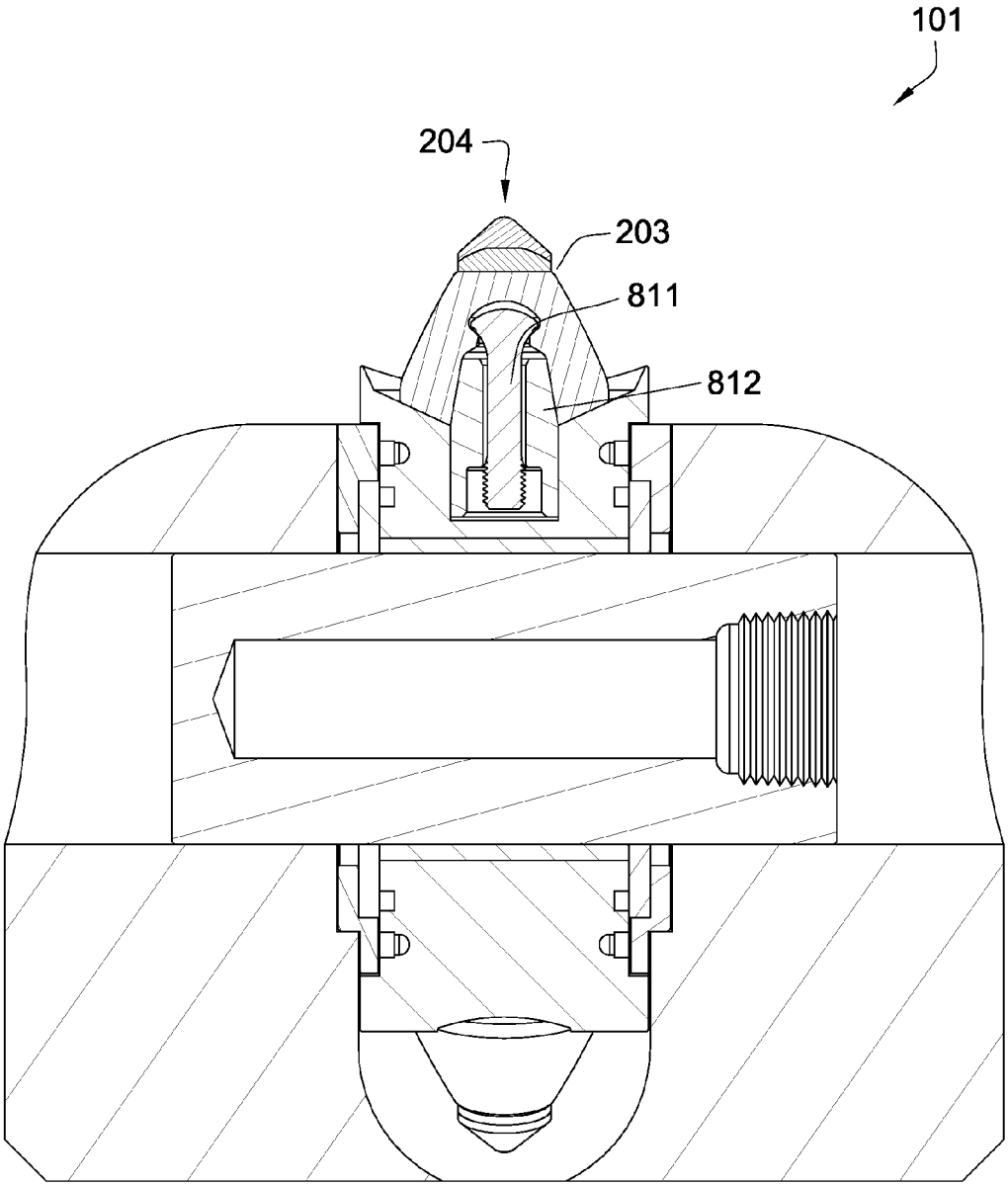
FIG. 17 is a cross sectional diagram of another embodiment of a roller assembly.

FIG. 17 shows a cross-sectional view of another embodiment of a roller assembly 101. The pointed inserts 203 may be disposed along the outer surface of the cylindrical body 202. The pointed inserts 203 may comprise an impact tip 204. The pointed inserts 203 may be mounted on the outer surface of the cylindrical body 202 by a threaded pin 811. The pin 811 may mate with a shank 812 which may be press fit into the cylindrical body 202.

Figure 18:
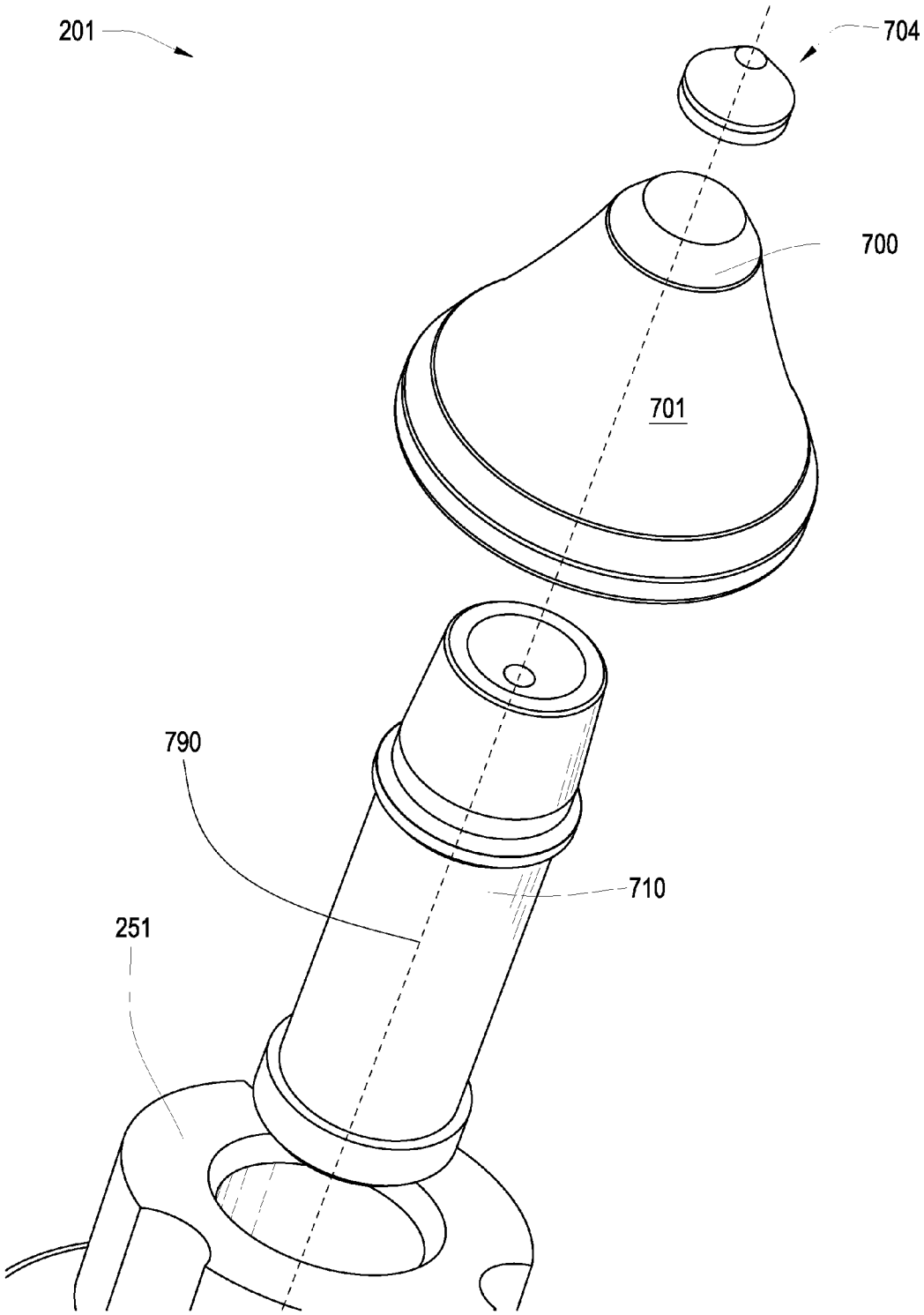
FIG. 18 is an exploded diagram of an embodiment of a pick assembly.

FIG. 18 is an exploded diagram of an embodiment of a pick assembly 201. The pick assembly 201 may comprise a super hard material bonded to a cemented metal carbide substrate 700 at a non-planar interface. Together the metal carbide substrate 700 and the super hard material form a tip 704. The cemented metal carbide substrate 700 may be bonded to a front end 703 of a cemented metal carbide bolster 701 and a shank 710 that may fit within a holder 251. The assembly 201 may also rotate along its central axis 790 within the holder 251.

Whereas the present invention has been described in particular relation to the drawings attached hereto, it should be understood that other and further modifications apart from those shown or suggested herein, may be made within the scope and spirit of the present invention.

What is claimed is:

1. A roller assembly, comprising;

an axel supporting opposing faces of a cylindrical body comprising a plurality of pointed inserts disposed along an outer diameter of the cylindrical body;

at least one of the inserts comprising a tip with a polycrystalline diamond bonded to a cemented metal carbide segment;

the diamond comprising a substantially conical geometry with a 0.50 to 0.200 inch radius apex and comprising a thickness greater than 0.100 inches at the apex; and an internal lubrication mechanism adapted to apply lubrication between the axel and the cylindrical body.

2. The roller assembly of claim 1, wherein the roller assembly is exteriorly mounted on an outer surface of a driving mechanism adapted to engage a formation.

3. The roller assembly of claim 2, wherein a pick assembly comprising a shank and a tip on a central axis is also mounted on the outer surface and is adapted to contact the formation after the roller assembly.

4. The roller assembly of claim 2, wherein the driving mechanism is a drum.

5. The roller assembly of claim 2, wherein the driving mechanism is a trenching chain.

6. The roller assembly of claim 5, wherein the trenching chain comprises a plurality of links, wherein at least one roller assembly and/or at least one pick assembly is mounted on an outer surface of at least one link.

7. The roller assembly of claim 6, wherein the roller assembly and/or pick assembly is mounted offset another roller assembly and/or pick assembly on an adjacent link with respect to a direction of travel of the trenching chain.

8. The roller assembly of claim 5, wherein a scraper is also mounted on a link with the roller assembly; wherein the scraper is adapted to scrape the formation.

9. The roller assembly of claim 1, wherein the driving mechanism is adapted to move the outer surface in a predetermined direction, wherein the pick assembly is positioned within one foot behind the roller assembly with respect to the direction.

10. The roller assembly of claim 1, wherein the lubrication mechanism comprises a lubricant reservoir disposed within the axel.

11. The roller assembly of claim 10, wherein a thickness of the cylindrical body measured between the opposing faces is smaller than the length of the lubricant reservoir and the lubricant reservoir extends beyond the opposing faces.

12. The roller assembly of claim 11, wherein the lubricant reservoir is pressurized.

13. The roller assembly of claim 11, wherein the lubricant reservoir comprises a port in fluid communication with a bearing surface between the axel and the cylindrical body.

14. The roller assembly of claim 11, wherein the lubricant mechanism comprises at least one o-ring disposed coaxially with and adjacent to the cylindrical body, wherein the o-ring substantially restricts lubricant from leaking from between the axel and the cylindrical body.

15. The roller assembly of claim 11, wherein the lubricant mechanism comprises a foam insert disposed within the lubricant reservoir.

16. The roller assembly of claim 1, wherein the roller assembly comprises a bushing disposed concentrically with the cylindrical body.

17. The roller assembly of claim 1, wherein every other insert of the plurality of pointed inserts is oriented in an opposing direction.

18. The roller assembly of claim 1, wherein the pointed inserts on the cylindrical body are each oriented such that the degree of variance between any two insert orientations is less than 90.

19. The roller assembly of claim 1, wherein the pointed inserts are brazed to a bolster mounted on the cylindrical body.

20. The roller assembly of claim 1, wherein the bolster comprises a flat incorporated within its base perimeter.

* * * * *